US012590723B2

(12) United States Patent
Carpenter

(10) Patent No.: US 12,590,723 B2
(45) Date of Patent: Mar. 31, 2026

(54) HVAC SYSTEM WITH WIRELESS DAMPER AND ZONING CONTROL

(71) Applicant: Lennox Industries Inc., Richardson, TX (US)

(72) Inventor: Kenneth Scott Carpenter, Rockwall, TX (US)

(73) Assignee: Lennox Industries Inc., Richardson, TX (US)

( * ) Notice: Subject to any disclaimer, the term of this patent is extended or adjusted under 35 U.S.C. 154(b) by 847 days.

(21) Appl. No.: 17/822,194

(22) Filed: Aug. 25, 2022

(65) Prior Publication Data

US 2024/0068689 A1 Feb. 29, 2024

(51) Int. Cl.
*F24F 11/56* (2018.01)
*F24F 11/63* (2018.01)
*F24F 13/10* (2006.01)

(52) U.S. Cl.
CPC ..... *F24F 11/56* (2018.01); *F24F 11/63* (2018.01); *F24F 13/10* (2013.01)

(58) Field of Classification Search
CPC ..... F24F 11/56; F24F 11/63; F24F 13/10
USPC ..... 454/256, 239, 229
See application file for complete search history.

(56) References Cited

U.S. PATENT DOCUMENTS

2011/0031322 A1* 2/2011 Zou ..... F24F 3/0442 236/1 B
2013/0324027 A1* 12/2013 Davis ..... F24F 11/30 454/258
2015/0019022 A1* 1/2015 Karamanos ..... G01F 1/42 700/276

OTHER PUBLICATIONS

Lennox Industries Inc., "iHarmony Zoning System®—Damper Control Module (10C16) Installation and Setup Guide," dated May 2020, 28 pages.

* cited by examiner

*Primary Examiner* — Vivek K Shirsat
(74) *Attorney, Agent, or Firm* — Baker Botts L.L.P.

(57) ABSTRACT

A heating, ventilation, and air conditioning (HVAC) system includes a thermostat comprising a processor configured to determine instructions for providing a flow of conditioned air to a first zone of the HVAC system. The HVAC system includes a damper located in a duct associated with the first zone of the HVAC system. The damper includes a moveable plate configured to block the flow of conditioned air through the duct when the movable plate is in a closed position and allow the flow of conditioned air through the duct when the movable plate is in an at least partially open position. The damper includes a wireless receiver and transmitter configured to receive the instructions for providing the flow of conditioned air to the first zone. The damper includes an actuator configured to move the movable plate based at least in part on the received instructions, thereby adjusting the flow of conditioned air to the first zone.

18 Claims, 4 Drawing Sheets

HVAC SYSTEM WITH WIRELESS DAMPER AND ZONING CONTROL

TECHNICAL FIELD

This disclosure relates generally to heating, ventilation, and air conditioning (HVAC) systems. More particularly, in certain embodiments, this disclosure relates to an HVAC system with wireless damper and zoning control.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

In some cases, it is desirable to provide flows of conditioned air to different zones of a space being serviced by an HVAC system. For example, a single evaporator coil may provide cooled air that can be sent to two or more zones, corresponding, for instance, to different sections or rooms of a building. When cooling is not needed to one zone, a damper may be closed to prevent the flow of conditioned air to that zone. However, in previous HVAC systems it can be difficult (e.g., costly, time-intensive, resource intensive or even impossible (e.g., if sufficient control infrastructure is not already in place) to retrofit an HVAC system to add additional zones. Furthermore, previously available dampers for controlling airflow to separate zones typically only open or close to provide binary on or off states for the flow of conditioned air. No further control of the airflow to different zones was possible. Instead, a signal is sent to open or close the damper to a given zone, and information is not provided to confirm that the action was successful or what impact the action had on the airflow provided to the zone. Additionally, previous zoned HVAC systems are limited on the number of possible zones, for example, because of the limited availability of wired interface connections on conventional control systems.

This disclosure solves problems of previous zoned HVAC systems by facilitating improved damper control. The improved zoned HVAC systems of this disclosure include dampers that wirelessly communicate with the thermostat and/or controller that provides instructions for zone operations. For example, a wireless receiver/transmitter of the damper may receive instructions for opening and closing the moveable plate of the damper in order to adjust the flow of air to its corresponding zone. A zone temperature sensor may measure a zone temperature that is used to determine when and/or how much conditioned air should be provided to the zone. The degree of openness of the damper's plate can be adjusted to more effectively and efficiently reach and/or maintain a target or setpoint temperature. In this way, zones can be controlled more effectively, resulting in overall improvements to HVAC system efficiency and the comfort provided to occupants of a space.

Furthermore, in some cases, the dampers include or are coupled to one or more sensors, such as flow rate sensors and/or pressure sensors, that can provide feedback regarding how the damper is performing and/or an amount or quality of air provided to a corresponding zone. This feedback can be used to appropriately adjust the degree of openness of the damper's movable plate and/or detect/diagnose problems with the damper (e.g., a broken actuator motor). Additionally, existing HVAC infrastructure may be more readily retrofitted to include the wireless dampers of this disclosure, for example, because additional dampers can be added without extensive rewiring of the control system and because the number of zones is not limited by availability of physical inputs in a controller interface.

Certain embodiments may include none, some, or all of the above technical advantages. One or more other technical advantages may be readily apparent to one skilled in the art from the figures, descriptions, and claims included herein.

In an embodiment, an HVAC system includes a thermostat comprising a processor configured to determine instructions for providing a flow of conditioned air to a first zone of the HVAC system. The HVAC system includes a damper located in a duct associated with the first zone of the HVAC system. The damper includes a moveable plate configured to block the flow of conditioned air through the duct when the movable plate is in a closed position and allow the flow of conditioned air through the duct when the movable plate is in an at least partially open position. The damper includes a wireless receiver and transmitter configured to receive the instructions for providing the flow of conditioned air to the first zone. The damper includes an actuator configured to move the movable plate based at least in part on the received instructions, thereby adjusting the flow of conditioned air to the first zone.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1-4 of the drawings, like numerals being used for like and corresponding parts of the various drawings.

As described above, prior to the present disclosure, zoned HVAC systems had limited control options due to the typically simple wired connectivity between zone dampers and a controller. The conventional control schemes of previous technology provided only one-way communication to the zone dampers for either closing or opening the dampers. Furthermore, previous HVAC systems were difficult or impossible to retrofit to add additional zones. The wireless zone dampers described with respect to FIGS. 1-4 below solve these and other problems of previous technology.

Example HVAC System

Figure 1:
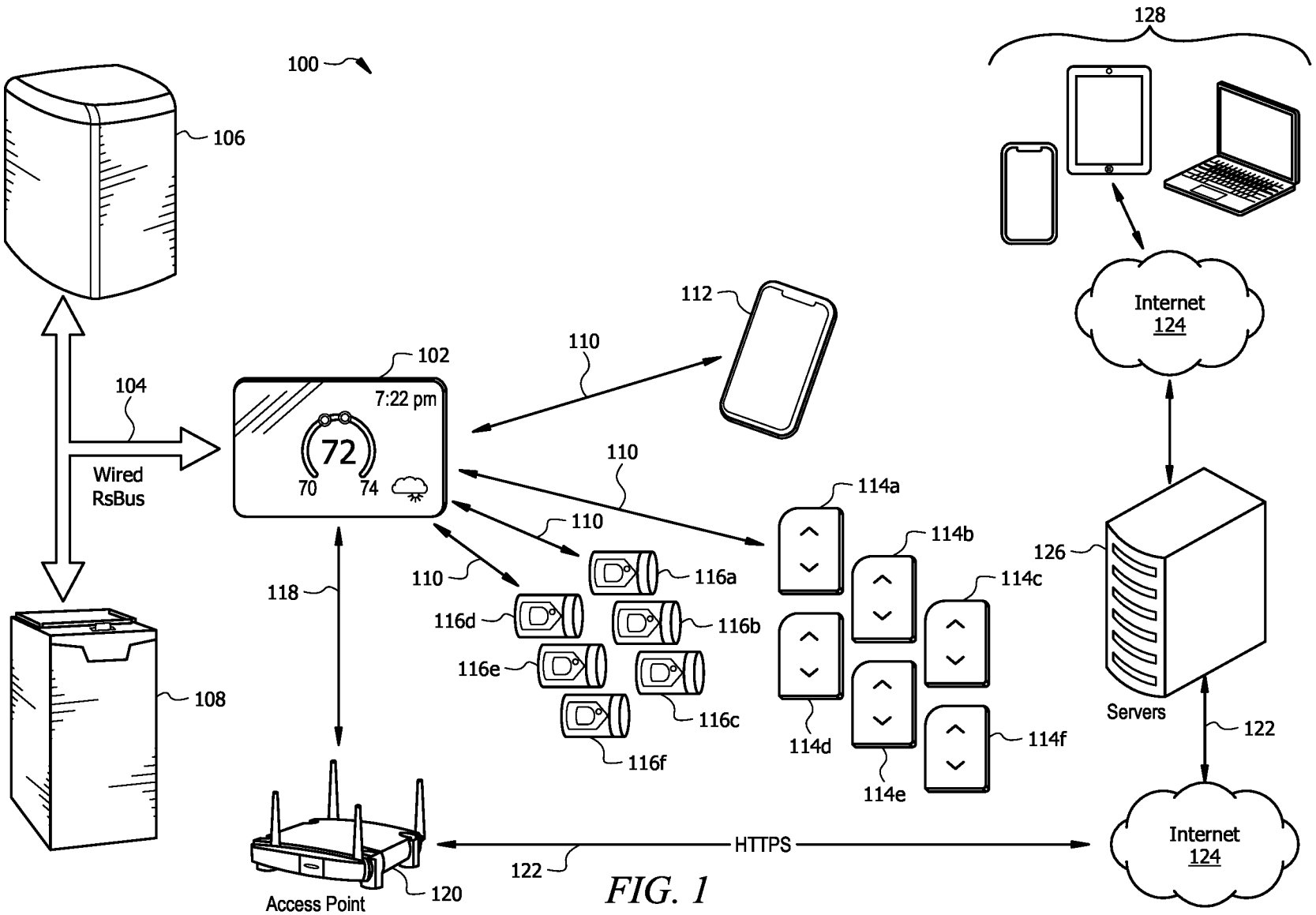
FIG. 1 is a diagram of an example HVAC system with wireless zone control.

FIG. 1 shows an example HVAC system 100 with zone control. The system 100 includes a thermostat 102, a condensing unit 106, a heating unit 108, a mobile device 112, wireless zone temperature sensors 114*a-f*, and corresponding wireless zone dampers 116*a-f*. The HVAC system 100 conditions air for delivery to a various zones of a conditioned space (e.g., all or a portion of a room, a house, an office building, a warehouse, or the like). The HVAC system 100 may be configured as shown in FIG. 1 or in any other suitable configuration. For example, the HVAC system 100 may include additional components or may omit one or more components shown in FIG. 1.

The thermostat 102 generally determines an amount of conditioned air that should be provided to each zone serviced by the HVAC system 100. The thermostat 102 is generally located within the conditioned space (e.g., a room or building) serviced by the HVAC system 100. While a single thermostat 102 is illustrated in FIG. 1, the HVAC system 100 may include additional thermostats and or one or more associated controllers that may work together or separately to achieve the functionality described in this disclosure. The thermostat 102 is configured to allow a user to input a desired temperature or setpoint temperature for each zone of the conditioned space. The thermostat 102 may include a user interface and display for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for display of messages related to the status and/or operation of the HVAC system 100 (e.g., related to the cooling or heating provided to each zone of the HVAC system 100). Further details of an example thermostat 102 and its operation are described with respect to FIGS. 3 and 4 below.

In the example of FIG. 1, the thermostat 102 is connected via a wired connection to a condensing unit 106 and a heating unit 108 via wired connection. As an example, the condensing unit 106 may be an outdoor unit with a compressor, a condenser, and a fan. The heating unit 108 may be an indoor furnace. The thermostat 102 provides commands and/or signals to control operation of the condensing unit 106 and heating unit 108. The thermostat 102 may also receive signals from the condensing unit 106 and heating unit 108 corresponding to their status (e.g., whether the HVAC components are operating and their operational parameters). The thermostat 102 may have a wired connection to additional HVAC components that are not illustrated in FIG. 1 for clarity and conciseness, such as one or more controllers, valves, sensors, and the like. The wireless connection may be achieved through any appropriate wired connection, such as an appropriate serial bus connection (e.g., the RsBus connection illustrated in FIG. 1).

The thermostat 102 is in wireless communication via wireless connections 110 to mobile device 112, zone temperature sensors 114*a-b*, and wireless zone dampers 116*a-f*. Wireless connection 110 may be achieved through Bluetooth communication or another method of relatively short-range two-way communication. The mobile device 112 may be used to configure the thermostat 102 and/or other components of the HVAC system 100 at the time of installation. In some cases, the mobile device 112 may facilitate communication of user commands to the thermostat 102 and/or the presentation of various status messages, as described above with respect to the display of the thermostat 102 (e.g., zone temperatures, zone setpoints, and the like) on the mobile device 112.

The thermostat 102 is in wireless communication via wireless connections 110 to zone temperature sensors 114*a-f*. A zone temperature sensor 114*a-f* is located in each zone serviced by the HVAC system 100. As described further below with respect to FIGS. 3 and 4, zone temperatures measured by the zone temperature sensors 114*a-f* may be used to determine a degree of openness at which to set the wireless zone damper 116*a-f* for each zone. As used herein, the degree of openness refers to a percentage of a duct in which the wireless zone damper 116*a-f* is installed that is not blocked to prevent or restrict the flow of air. The degree of openness determines an amount of airflow that is allowed through a duct associated with a zone of the HVAC system 100. For example, if the temperature for a zone is far from the setpoint, the wireless zone damper 116*a-f* for the zone may be set to a fully open position (airflow is not significantly restricted or blocked through the duct). However, if the zone's setpoint has been reached, the wireless zone damper 116*a-f* may be closed for the zone (airflow is blocked in the duct), since conditioned air is not needed.

The thermostat 102 is in wireless communication via wireless connections 110 to the wireless zone dampers 116*a-f*. In the example of FIG. 1, the conditioned space includes six zones, each with a corresponding zone temperature sensor 114*a-f* and wireless zone damper 116*a-f*. As described further with respect to FIG. 3 below, each wireless zone damper 116*a-f* is located in a duct providing airflow to a corresponding zone. Airflow to each zone is controlled through instructions (e.g., instructions 336 of FIG. 3) provided from the thermostat 102 that indicates the degree of openness of a moveable plate in the wireless zone damper 116*a-f* for the zone. To further improve overall performance and efficiency of the HVAC system 100, the degree of openness of the wireless zone dampers 116*a-f* can be adjusted over time based on measured zone temperatures, air flowrates in the zone ducts, and/or air pressure in the zone ducts. Possible malfunctions of the wireless zone dampers 116*a-f* may also be detected using this information. Further details of the structure and operation of an example wireless zone damper 116*a-f* are provided below with respect to FIGS. 3 and 4.

Figure 2:
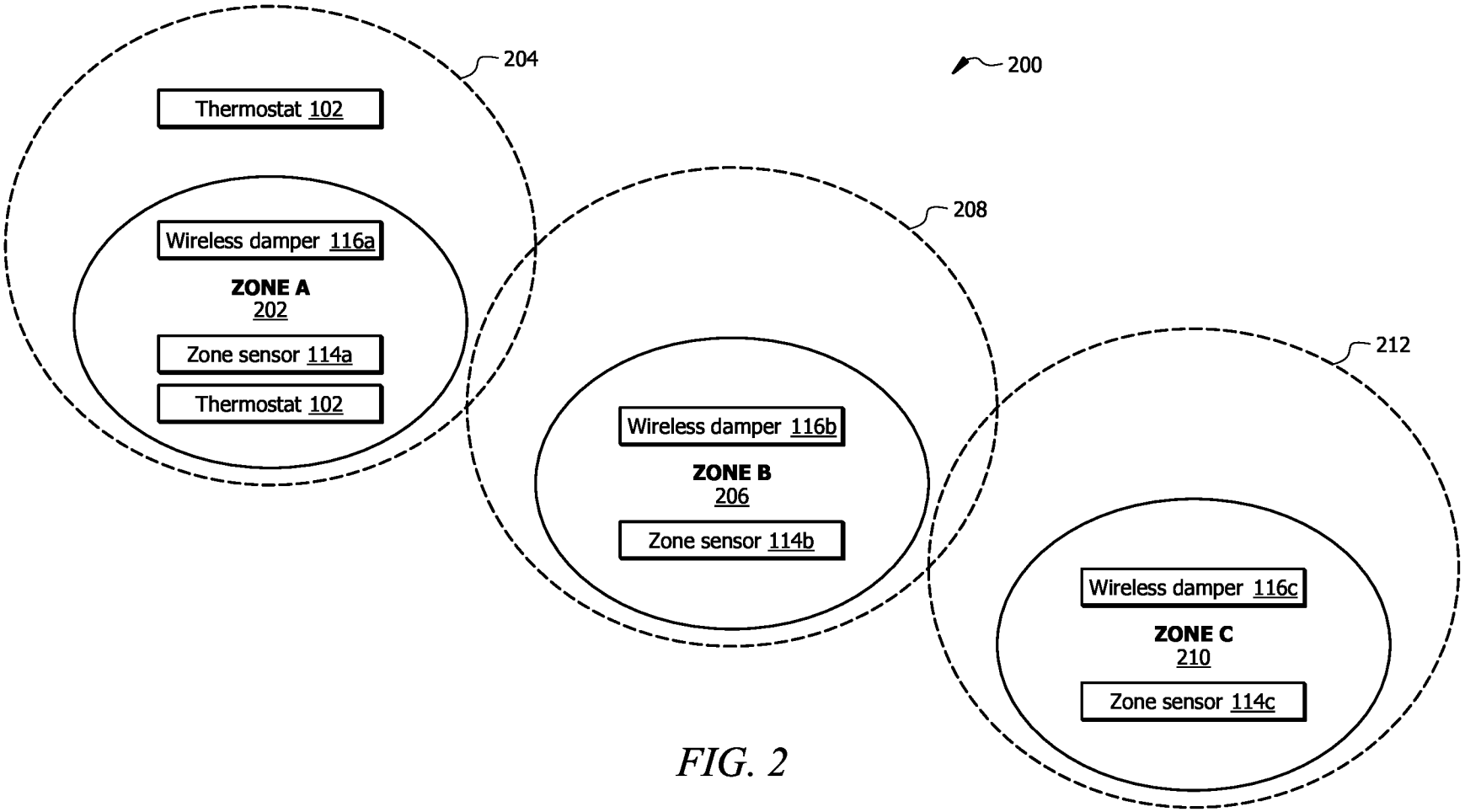
FIG. 2 is a diagram illustrating the connectivity of multiple wireless zone dampers to form a mesh network in the system of FIG. 1.

In some cases, multiple wireless zone dampers 116*a-f* may form a mesh communication network to facilitate communication between the thermostat 102 and any wireless zone dampers that are at a sufficiently great distance from the thermostat 102 to be out of range using direct communication over wireless connection 110. FIG. 2 illustrates an example of such a mesh network 200. In the example of FIG. 2, three wireless zone dampers 116*a-c* and corresponding zone temperature sensors 114*a-c* are deployed in three different zones 202, 206, 210. Each wireless zone damper 116*a-c* shown in FIG. 2 has a wireless transmitter and receiver (see FIG. 3 for more details) that can communicate over a corresponding communication area 204, 208, 212 (i.e., corresponding to the range of signals sent by the wireless transmitter and receiver of the wireless zone damper 116*a-f*). In this example, only the first zone 202 of wireless zone damper 116*a* is within range for directly communicating with thermostat 102. Mesh network 200 facilitates communication between thermostat 102 and the remaining wireless zone dampers 116*b* and 116*c* by allowing signals to be sent through adjacently located wireless zone dampers 116*a-c* that have overlapping communication areas 204, 208, 212. For example, information to be sent from thermostat 102 to wireless zone damper 116*c* of the third zone 210 can be transmitted via wireless zone dampers 116*a* and 116*b*.

Returning to the example of FIG. 1, the HVAC system 100 may be in communication with other devices, such as servers 126 and/or computing devices 128 via network 124 and network access point 120 using network connections 118. Network connections 118 may be wired and/or wireless network connections. Network connections 118 are different than wireless connections 110. The servers 126 may provide information for updating and/or monitoring operation of the thermostat 102. For instance, the servers 126 may provide weather data to the thermostat 102. The servers 126 may provide software updates to the thermostat 102. The computing devices 128 may facilitate communication of user commands to the thermostat 102 and/or the presentation of various status messages, as described above with respect to the display of the thermostat 102 (e.g., zone temperatures, zone setpoints, and the like). In some cases, a computing device 128 may be operated by a service provider of the HVAC system 100, such that a detected malfunction of a wireless zone damper or other HVAC system component can be addressed and corrected more efficiently.

In an example operation of the HVAC system 100, the HVAC system 100 includes two zones, including zone 202 and 206 of FIG. 2. During the day, the HVAC system 100 operates in an away mode, such that the temperatures in the zones 202, 206 are allowed to increase until a predetermined time when individuals are expected to return to the building in which the zones 202, 206 are located. One zone 202 increases in temperature more than the other zone 206 throughout the day, such that the first zone 202 is hotter than the second zone 206. When the HVAC system 100 exits the away mode and begins providing cooling, the wireless zone damper 116*a* of the first zone 202 is opened more than the wireless zone damper 116*b* for the second zone 206, such that the first zone 202 receives a greater flow of conditioned air and can be cooled more rapidly from its higher temperature. Energy is saved because, excess conditioned air is not sent to zone 206, which requires less cooling. Previous zoned HVAC systems would cool zone 202 more slowly and may overcool zone 206, resulting in decreased occupant comfort and wasted energy for cooling. If the zone air flowrate 318 to the second zone 202 exceeds a threshold value, the speed of the blower providing the conditioned air may be decreased or a compressor speed may be decreased. This may provide further improvements to the efficiency of the HVAC system 100 while still providing comfort to occupants of the conditioned space.

Example Wireless Damper and Thermostat Operation

Figure 3:
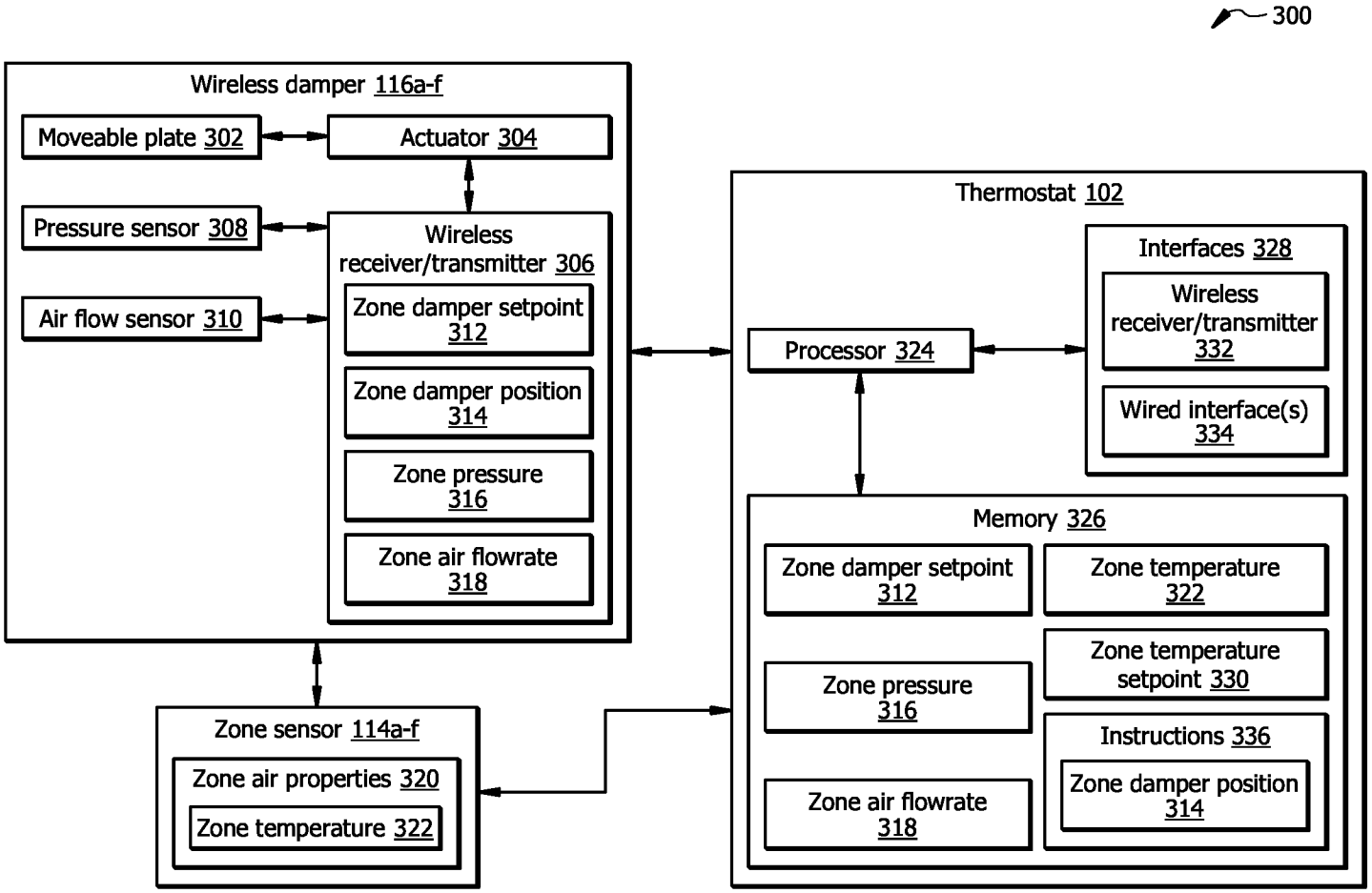
FIG. 3 is a block diagram of an example wireless damper, zone sensor, and thermostat of the system of FIG. 1.

FIG. 3 is a diagram 300 showing an example zone temperature sensor 114*a-f*, wireless zone damper 116*a-f*, and thermostat 102 of the HVAC system 100 of FIG. 1 in greater detail.

The wireless zone damper 116*a-f* includes a moveable plate 302, an actuator 304, and a wireless receiver and transmitter 306. The moveable plate 302 is configured to block the flow of conditioned air through the duct in which the wireless zone damper 116*a-f* is located when the moveable plate 302 is in a closed position and allow the flow of conditioned air through the duct when the movable plate 302 is in an at least partially open position. The actuator 304 includes a motor or other device for moving the moveable plate between the open and closed positions and, optionally, to intermediate positions in which the duct is partially open. The actuator 304 may be an electronic motor or similar device. At any given time, the moveable plate 302 may be at a zone damper position 314.

The wireless receiver and transmitter 306 sends information to and receives information from the thermostat 102. The wireless receiver and transmitter 306 may be in communication with the zone temperature sensor 114*a-f*. The wireless receiver and transmitter 306 may be a Bluetooth receiver and transmitter. For example, the wireless receiver and transmitter 306 may receive instructions 336 from the thermostat 102 indicating a zone damper setpoint 312 (e.g., indicating a degree of openness at which to set the movable plate 302) at which to set the moveable plate 302. As another example, the wireless receiver and transmitter 306 may send a zone air pressure 316 measured by the pressure sensor 308 and/or a zone air flowrate 318 measured by air flow sensor 310, as described further below. Instructions 336 received by the wireless receiver and transmitter 306 are used to cause the actuator 304 to move the moveable plate 302 from a current zone damper position 314 to a zone damper setpoint 312 indicated by the thermostat 102.

The wireless zone damper 116*a-f* may include or may be in communication with a pressure sensor 308 and/or an air flow sensor 310. The pressure sensor 308 measures a pressure of air in the duct in which the wireless zone damper 116*a-f* is located. The air flow sensor 310 measures a flow rate of conditioned air through the duct in which the wireless zone damper 116*a-f* is located. Information from the pressure sensor 308 and/or the air flow sensor 310 may be used to adjust (e.g., continuously or at intervals) the degree of openness of the moveable plate 302 (e.g., by updating the zone damper setpoint 312).

The zone temperature sensor 114*a-f* measures one or more air properties 320 (e.g., zone temperature 322, zone humidity, zone occupancy, or the like) of the zone in which the wireless zone temperature sensor 114*a-f* is deployed. The zone temperature sensor 114*a-f* measures a zone temperature 322, which, as described below can be used to determine a zone damper setpoint 312 indicating a degree of openness to which the wireless zone damper 116*a-f* should be adjusted.

The thermostat 102 receives information from the wireless zone damper 116*a-f*, wireless zone temperature sensor 114*a-f*, pressure sensor 308, and/or air flow sensor 310; uses this information to determine zone damper setpoint 312 corresponding to a degree of openness at which to set the moveable plate 302; and provides instructions 336 to the wireless zone damper 116*a-f* to adjust the moveable plate 302 accordingly. For example, the thermostat 102 may compare the zone temperature 322 to a zone temperature setpoint 330 to determine whether conditioned air should be provided to the zone. If no conditioned air is needed, the zone damper setpoint 312 may correspond to a closed position, such that no air can flow through the duct to reach the zone. If the zone temperature 322 is far from the zone temperature setpoint 330 (e.g., if the difference between the zone temperature 322 and the zone temperature setpoint 330 is greater than a threshold value), the zone damper setpoint 312 may correspond to a fully open position (e.g., a 100% degree of openness). For intermediate differences between the zone temperature 322 and the zone temperature setpoint 330, the zone damper setpoint 312 may correspond to a partial degree of openness of the moveable plate 302. For example, the degree of openness may scale as appropriate with the difference between the zone temperature 322 and the zone temperature setpoint 330.

In some cases, the thermostat 102 may detect a malfunction of the wireless zone damper 116*a-f* and/or another HVAC system component based at least in part on the zone air pressure 316 and/or the zone air flowrate 318. For example, if the zone air pressure 316 and/or the zone air flowrate 318 do not change following an instruction to change the zone damper position 314 (i.e., when an instruction with a new zone damper setpoint 312 is sent), then the wireless zone damper 116*a-f* may be malfunctioning. For example, the actuator 304 may not be properly opening and closing the moveable plate 302.

The thermostat 102 may include a processor 324, memory 326, and input/output (I/O) interface 328. The processor 324 includes one or more processors operably coupled to the memory 326. The processor 324 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 326 and controls the operation of HVAC system 100. The processor 324 may be a programmable logic device, a microcontroller, a microprocessor, or any suitable combination of the preceding. The processor 324 is communicatively coupled to and in signal communication with the memory 326. The one or more processors are configured to process data and may be implemented in hardware or software. For example, the processor 324 may be 8-bit, 16-bit, 32-bit, 64-bit or of any other suitable architecture. The processor 324 may include an arithmetic logic unit (ALU) for performing arithmetic and logic operations, processor registers that supply operands to the ALU and store the results of ALU operations, and a control unit that fetches instructions from memory 326 and executes them by directing the coordinated operations of the ALU, registers, and other components. The processor may include other hardware and software that operates to process information, control the HVAC system 100, and perform any of the functions described herein (e.g., with respect to FIGS. 1-4). The processor 324 is not limited to a single processing device and may encompass multiple processing devices.

The memory 326 includes one or more disks, tape drives, or solid-state drives, and may be used as an over-flow data storage device, to store programs when such programs are selected for execution, and to store instructions and data that are read during program execution. The memory 326 may be volatile or non-volatile and may comprise ROM, RAM, ternary content-addressable memory (TCAM), dynamic random-access memory (DRAM), and static random-access memory (SRAM). The memory 326 is operable to store any suitable set of instructions, logic, rules, and/or code for executing the functions described in this disclosure with respect to FIGS. 1-4. For example, the memory 326 may store the instructions 336, zone temperatures 322, zone temperature setpoints 330, zone damper setpoint 312 (i.e., the target degree of openness of the moveable plate 302), the zone damper position 314 (i.e., the actual degree of openness of the moveable plate 302), zone air pressure 316, and zone air flowrate 318.

The I/O interface 328 is configured to communicate data and signals with other devices. The I/O interface 328 includes a wireless transmitter and receiver 332, such as a Bluetooth transmitter and receiver for communicating over wireless connection 110 of FIG. 1 and/or a WiFi transmitter and receiver for communicating over network connection 122 of FIG. 1. The I/O interface 328 includes one or more wired interfaces 334 (e.g., any appropriate serial buses) for communicating over wired connection 104 of FIG. 1. For example, the I/O interface 328 may be configured to communicate electrical signals with the other components of the HVAC system 100. The I/O interface 328 may comprise ports and/or terminals for establishing signal communications between the thermostat 102 and other devices.

Example Method of Operation

Figure 4:
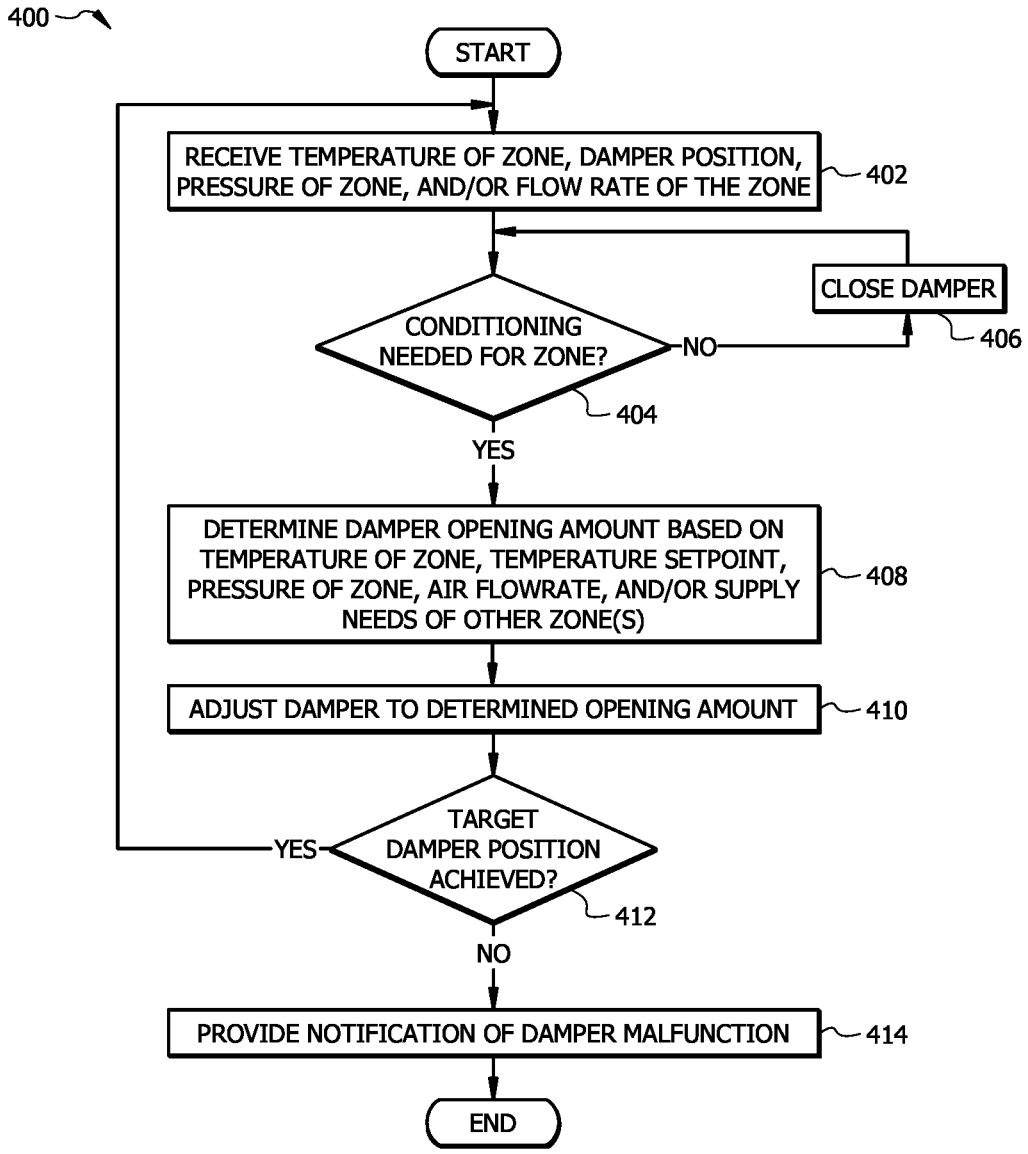
FIG. 4 is a flowchart of an example method of operating the system of FIG. 1.

FIG. 4 is a flowchart of an example method 400 of operating the system of FIGS. 1 and 3. Method 400 may begin at operation 402 where the thermostat 102 receives a current or recent zone temperature 322, zone damper position 314, zone air pressure 316, and/or zone air flowrate 318.

At operation 404, the thermostat 102 determines whether conditioned air should be provided to the zone. For example, if the HVAC system 100 is providing cooling and the zone temperature 322 is greater than the zone temperature setpoint 330, then conditioned air should generally be provided to the zone. If conditioned air is not needed at the zone, the thermostat 102 may proceed to operation 406 and provide instructions 336 with a damper setpoint 312 indicating to close the wireless zone damper 116*a-f*. The actuator 304 then causes the moveable plate 302 to move to close the wireless zone damper 116*a-f* and block the flow of conditioned air to the zone. If conditioned air is needed at the zone, the thermostat 102 proceeds to operation 408.

At operation 408, the thermostat 102 determines a damper setpoint 312 corresponding to a degree of openness of the wireless zone damper 116*a-f*. The damper setpoint 312 may be determined using one or more of the zone temperature 322, the zone air pressure 316, and the zone air flowrate 318. For example, a damper setpoint 312 may be determined that causes the wireless zone damper 116*a-f* to have a higher degree of openness more if a larger amount of cooling is needed in the zone (e.g., if the zone temperature 322 is relatively far from the zone temperature setpoint 330). In some cases, the damper setpoint 312 may be adjusted to achieve a target zone air flowrate 318. The target zone air flowrate 318 may be predefined for the zone or determined based at least in part on the amount of cooling needed in the zone. In some cases, the damper setpoint 312 may be adjusted to achieve a target zone air pressure 316 in the duct in which the wireless zone damper 116*a-f* is installed. The target zone air pressure 316 may be predefined for the zone or determined based at least in part on the amount of cooling needed in the zone.

At operation 410, the thermostat wirelessly transmits instructions 336 indicating the damper setpoint 312. The actuator 304 causes the moveable plate 302 to move to reach the damper setpoint 312. At operation 412, the thermostat 102 may determine whether the moveable plate 302 successfully moved to the damper setpoint 312. For example, the thermostat may compare the zone damper position 314 to the damper setpoint 312 to determine whether these positions are the same. If they are not the same, then the wireless zone damper 116*a-f* may not have successfully achieved the damper setpoint 312. As another example, the thermostat 102 may determine whether the zone air pressure 316 and/or zone air flowrate 318 changed in a manner that indicates the damper setpoint 312 was achieved. If the damper setpoint 312 is achieved, the thermostat 102 returns to the start of method 400. If the damper setpoint 312 is not achieved, the thermostat 102 may send a notification of a possible malfunction of the wireless zone damper 116*a-f* at operation 414.

Modifications, additions, or omissions may be made to method 400 depicted in FIG. 4. Method 400 may include more, fewer, or other operations. For example, operations may be performed in parallel or in any suitable order. While at times discussed as the thermostat 102 performing the operations, any suitable components of the HVAC system 100 may perform one or more operations of the method 400.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system comprising:

a thermostat comprising a processor configured to determine instructions for providing a flow of conditioned air to a first zone of the HVAC system, the instructions indicating a damper setpoint;

a first damper located in a duct associated with the first zone of the HVAC system, the first damper comprising:

a moveable plate configured to block the flow of conditioned air through the duct when the moveable plate is in a closed position and allow the flow of conditioned air through the duct when the moveable plate is in an at least partially open position;

a wireless receiver and transmitter configured to receive the instructions for providing the flow of conditioned air to the first zone; and an actuator configured to move the moveable plate based at least in part on the received instructions, thereby adjusting the flow of conditioned air to the first zone, wherein the thermostat is further configured to:

receive feedback from the first damper; and determine whether the moveable plate is moved to the damper setpoint based at least in part upon the feedback; and one or more sensors configured to measure one or both of an air flowrate in the duct and an air pressure in the duct, wherein the processor of the thermostat is further configured to detect a malfunction of the first damper based on one or both of the measured air flowrate in the duct and the measured air pressure in the duct.

2. The HVAC system of claim 1, wherein the HVAC system further comprises a zone temperature sensor configured to measure a temperature of the first zone, wherein the processor of the thermostat is configured to the instructions for providing the flow of conditioned air to the first zone based at least in part on the temperature of the first zone.

3. The HVAC system of claim 1, wherein the instructions indicate a degree of openness for the moveable plate, and the actuator causes the moveable plate to open to the indicated degree of openness.

4. The HVAC system of claim 1, wherein the thermostat is further configured to:

in response to determining that the moveable plate is moved to the damper setpoint, determine that the damper setpoint was achieved;

in response to determining that the moveable plate is not moved to the damper setpoint, detect a malfunction in the first damper; and after detecting the malfunction in the first damper, notify a service provider of the malfunction detected in the first damper.

5. The HVAC system of claim 1, further comprising one or more sensors configured to measure one or both of an air flowrate in the duct and an air pressure in the duct, wherein:

the processor of the thermostat is further configured to adjust the instructions for providing the flow of conditioned air to the first zone based on one or both of the measured air flowrate in the duct and the measured air pressure in the duct; and the actuator causes the moveable plate to move to a degree of openness based on the adjusted instructions.

6. The HVAC system of claim 1, wherein the wireless receiver and transmitter is a wireless technology transmitter and receiver in communication with a wireless technology transmitter and receiver of the thermostat.

7. The HVAC system of claim 1, wherein the HVAC system further comprises a second damper located in a duct associated with a second zone of the HVAC system, wherein the second zone is different than the first zone and the second damper is located a greater distance from the thermostat than a distance between the thermostat and the first damper, the second damper comprising a second wireless receiver and transmitter configured to communicate with the thermostat via a mesh network formed by the second damper and the first damper.

8. A method of operating a heating, ventilation, and air conditioning (HVAC) system comprising:

receiving, via wireless communication from a zone temperature sensor located in a zone of the HVAC associated with the HVAC system, a temperature of the zone;

determining, based at least in part on the temperature of the zone, instructions for providing a flow of conditioned air to the zone, the instructions indicating a damper setpoint;

wirelessly transmitting the instructions to a damper located in a duct associated with the zone of the HVAC system;

causing a moveable plate of the damper to move to a closed position or an at least partially open position based at least in part on the received instructions, thereby adjusting the flow of conditioned air to the zone;

receiving feedback from the damper;

determine whether the moveable plate is moved to the damper setpoint based at least in part upon the feedback; and receiving one or both of a measured air flowrate in the duct associated with the zone and an air pressure in the duct associated with the zone; and detecting a malfunction of the damper based on one or both of the measured air flowrate in the duct and the measured air pressure in the duct.

9. The method of claim 8, wherein the instructions indicate a degree of openness for the moveable plate, and the method comprises opening the moveable plate of the damper to the indicated degree of openness.

10. The method of claim 8, further comprising:

in response to determining that the moveable plate is moved to the damper setpoint, determine that the damper setpoint was achieved;

in response to determining that the moveable plate is not moved to the damper setpoint, detect a malfunction in the damper; and after detecting the malfunction in the damper, notify a service provider of the malfunction detected in the damper.

11. The method of claim 8, further comprising:

receiving one or both of a measured air flowrate in the duct associated with the zone and an air pressure in the duct associated with the zone;

adjusting the instructions for providing the flow of conditioned air to the zone based on one or both of the measured air flowrate in the duct and the measured air pressure in the duct; and causing the moveable plate to move to a degree of openness based on the adjusted instructions.

12. The method of claim 8, wherein wirelessly transmitting the instructions to the damper comprises sending the instructions using a wireless technology transmitter and receiver of a thermostat of the HVAC system.

13. A damper located in a duct associated with a zone of a heating, ventilation, and air conditioning (HVAC) system, the damper comprising:

a moveable plate configured to block a flow of conditioned air through the duct when the moveable plate is in a closed position and allow the flow of conditioned air through the duct when the moveable plate is in an at least partially open position;

a wireless receiver and transmitter configured to receive instructions from a thermostat of the HVAC system for providing the flow of conditioned air to the zone, the instructions indicating a damper setpoint; and an actuator configured to move the moveable plate based at least in part on the received instructions, thereby adjusting the flow of conditioned air to the zone, wherein the thermostat is further configured to:

receive feedback from the damper; and determine whether the moveable plate is moved to the damper setpoint based at least in part upon the feedback;

wherein the HVAC system further comprises one or more sensors configured to measure one or both of an air flowrate in the duct and an air pressure in the duct, wherein the thermostat is further configured to detect a malfunction of the damper based on one or both of the measured air flowrate in the duct and the measured air pressure in the duct.

14. The damper of claim 13, wherein the instructions indicate a degree of openness for the moveable plate, and the actuator causes the moveable plate to open to the indicated degree of openness.

15. The damper of claim 13, wherein the thermostat is further configured to:

in response to determining that the moveable plate is moved to the damper setpoint, determine that the damper setpoint was achieved;

in response to determining that the moveable plate is not moved to the damper setpoint, detect a malfunction in the damper; and after detecting the malfunction in the damper, notify a service provider of the malfunction detected in the damper.

16. The damper of claim 13, wherein the actuator causes the moveable plate to move to a degree of openness determined based on one or both of the measured air flowrate in the duct and the measured air pressure in the duct.

17. The damper of claim 13, wherein the wireless receiver and transmitter is a wireless technology transmitter and receiver in communication with a wireless technology transmitter and receiver of the thermostat of the HVAC system.

18. The damper of claim 17, wherein the wireless technology transmitter and receiver of the damper is in communication with the wireless technology transmitter and receiver of the thermostat via a mesh network formed at least in part by the wireless technology transmitter and receivers of other dampers of the HVAC system.

* * * * *